US006977634B2

(12) United States Patent
Kim et al.

(10) Patent No.: US 6,977,634 B2
(45) Date of Patent: Dec. 20, 2005

(54) APPARATUS AND METHOD FOR DRIVING IMAGE DISPLAY DEVICE

(75) Inventors: Young-sun Kim, Suwon-si (KR); Bong-hwan Cho, Gyeonggi-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 287 days.

(21) Appl. No.: 10/330,296

(22) Filed: Dec. 30, 2002

(65) Prior Publication Data

US 2003/0122756 A1 Jul. 3, 2003

(30) Foreign Application Priority Data

Dec. 31, 2001 (KR) ..... 2001-88848

(51) Int. Cl.[7] ..... G09G 3/36
(52) U.S. Cl. ..... 345/87; 345/98; 345/100
(58) Field of Search ..... 345/87, 89, 92–100

(56) References Cited

U.S. PATENT DOCUMENTS

| | | | | |
|---|---|---|---|---|
| RE34,295 | E * | 6/1993 | Shibuya et al. | 341/133 |
| 5,414,443 | A * | 5/1995 | Kanatani et al. | 345/95 |
| 6,140,989 | A * | 10/2000 | Kato | 345/89 |
| 6,181,311 | B1 * | 1/2001 | Hashimoto | 345/98 |
| 6,476,786 | B1 * | 11/2002 | Miyachi | 345/90 |
| 6,801,177 | B2 * | 10/2004 | Kudo et al. | 345/89 |

* cited by examiner

*Primary Examiner*—Alexander Eisen
*Assistant Examiner*—Kimnhung Nguyen
(74) *Attorney, Agent, or Firm*—Sughrue Mion, PLLC

(57) ABSTRACT

An apparatus and method are provided for driving an image display device by converting digital image data per pixel into an analog signal and driving a liquid crystal cell in response to the analog pixel signal, using a voltage charged with a driving circuit with a dual buffer structure. According to the apparatus, digital image data per pixel is converted into an analog signal to generate a voltage for driving an image display device, and an analog voltage for driving the image display device is generated using a driving circuit with a dual buffer structure. With the apparatus, it is possible to effectively prevent generation of undesired noise and display R.G.B. image signals using a single panel.

9 Claims, 4 Drawing Sheets

INPUT IMAGE DATA = 133 (10000101B)

R_min
G_max
B−min
W_max
R_min
G_max
B_min
W_max

5V
VLC
Vc
Vcom
0V
−5V

5V
VLC
0V

5V
Vcom
0V
Vc
−5V

St
H
L

Sc1
H
L

Ss
H
L

Vs
5V
0V

Sc2
H
L

APPARATUS AND METHOD FOR DRIVING IMAGE DISPLAY DEVICE

BACKGROUND OF THE INVENTION

This application claims the priority of Korean Patent Application No. 2001-88848 filed Dec. 31, 2001, which is incorporated herein in its entirety by reference.

1. Field of the Invention

The present invention relates to the field of image display devices, and more particularly, to an image display device and method for converting digital image data per pixel into an analog signal and driving a liquid crystal cell in response to the analog pixel signal using voltage charged by a driving circuit with a dual buffer structure.

2. Description of the Related Art

A liquid crystal display (LCD) is one type of flat display device used in computers, flat television receivers, and information appliances, and is made of a plurality of pixels having capacitive loads.

In general, an LCD consists of a plurality of pixels indicating an image signal, the pixels being driven in response to a signal that is applied via a wire. In a wire, scan signal lines or gate signal lines for transmitting scan signals, or image signal lines or data lines for transmitting image signals are connected, in the form of matrix, to a plurality of thin-film transistor (TFT) switching devices corresponding to the pixels. Each TFT is connected to a liquid crystal cell and thus displays an image signal.

As shown in FIG. 1, a conventional apparatus for driving an image display device includes a liquid crystal cell 1, a thin transistor 2, and a capacitor 3 for each pixel display unit. Gate and input terminals of the thin transistor 2 are connected to a gate signal line and a data signal line. One terminal of the liquid crystal cell 1 is connected to an output terminal of the thin transistor 2 and a pixel electrode is connected to the other terminal thereof. The liquid crystal cell 1 is connected in parallel to the capacitor 3.

The data signal line is for supplying voltage to the liquid crystal cell 1, and the gate signal line is for supplying a signal used to determine a line to which a liquid crystal cell of a scan line to be displayed belongs.

The thin transistor 2 accumulates voltage of the data signal line in the capacitor 3 to provide the voltage to the liquid crystal cell 1, in response to a signal supplied via the gate signal line.

As described above, each liquid crystal cell 1 is driven by the voltage charged in the capacitor 3.

In general, a conventional image display device displays one sheet of an image with R.G.B. cells in one vertical synchronization period (1/60 seconds). Therefore, in order to realize a single-panel projection television receiver using the conventional image display device, at least red, green and blue (R.G.B.) colors must be displayed within the one vertical synchronization period. However, the conventional image display device shown in FIG. 1 is not capable of driving all of the R.G.B. cells on a single panel within one vertical synchronization period.

SUMMARY OF THE INVENTION

To solve the above problem, it is an object of the present invention to provide an apparatus and method for driving an image display device which converts digital image data per pixel into an analog signal and drives a liquid crystal cell in response to the analog pixel signal using voltage charged with a driving circuit with a dual buffer structure.

To achieve the above object, there is provided an apparatus for driving an image display device, the apparatus including a digital-to-analog (D/A) converter converting digital image data into an analog pixel signal; a pixel driving unit receiving the analog pixel signal output from the D/A converter, switching the analog pixel signal to charge a first charging device with the analog pixel signal, switching the signal charged in the first charging device per frame to charge a second charging device with the signal, and discharging the signal for a previous frame, which is charged in the second charging unit and a liquid crystal cell, before charging the second charging device with a signal for a current frame; and the liquid crystal cell displaying an image using a difference between voltage of the pixel signal in the second charging device and a predetermined AC driving voltage.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
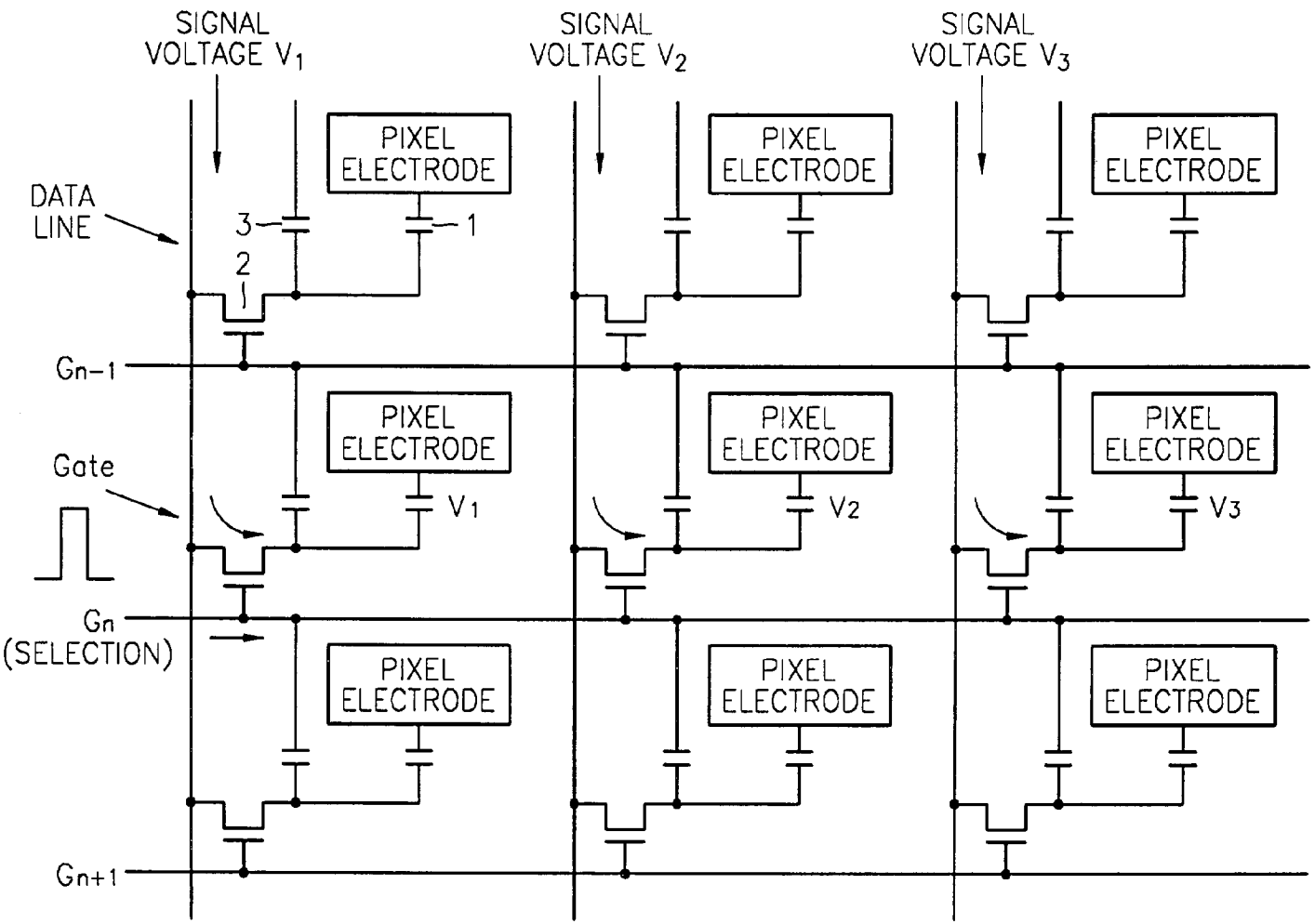
FIG. 1 (PRIOR ART)
FIG. 1 is a circuit diagram of a conventional image display device.
Figure 2:
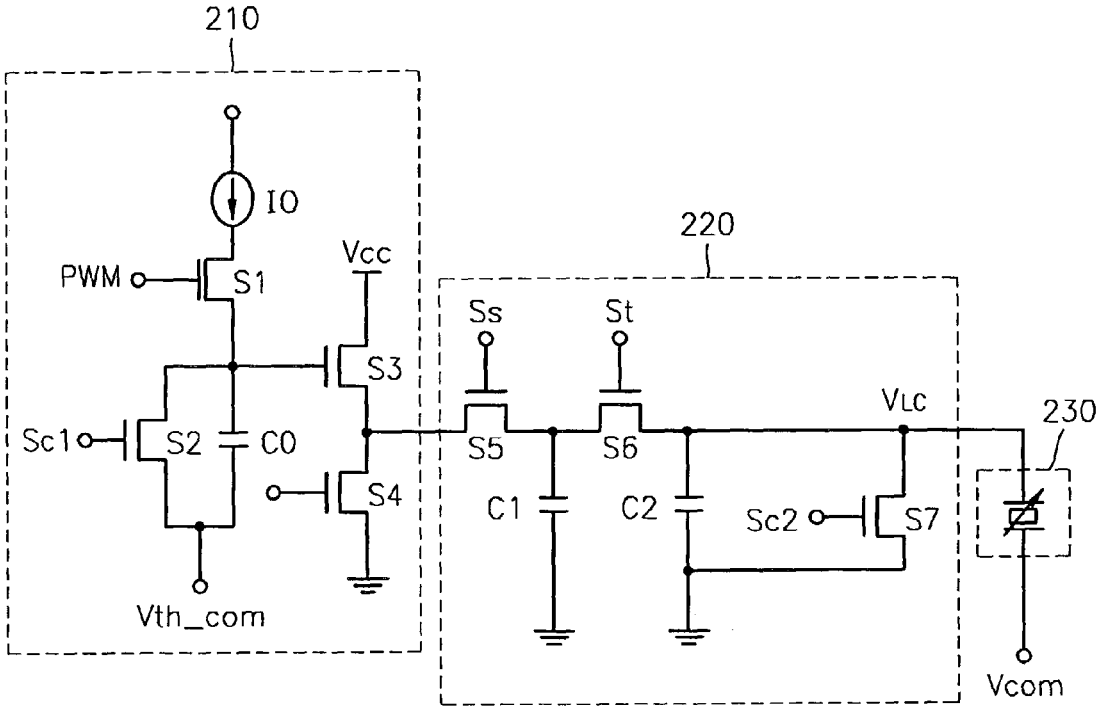
FIG. 2 is a circuit diagram of an apparatus for driving an image display device according to the present invention.

FIG. 2 is a circuit diagram of an apparatus for driving an image display device according to the present invention. Referring to FIG. 2, the apparatus includes a digital-to-analog (D/A) converter 210, a pixel driving unit 220, and a liquid crystal cell 230.

The D/A converter 210 converts digital image data into an analog pixel signal. More specifically, the D/A converter 210 includes a plurality of switches S1, S2, S3 and S4, a capacitor C0, and a current source $I_O$.

Digital image data having a modulated pulse width is applied to a gate terminal of the switch S1, and input/output (I/O) terminals of the switch S1 are connected to the current source $I_O$ and the capacitor C0, respectively.

The output terminal of the switch S1 is connected to a buffer circuit, which consists of the switches S3 and S4, to match output impedance in the switch S1 with output impedance in the pixel driving unit 220. The capacitor C0 is connected to the switch S2 for discharging a charged signal.

Figure 3:
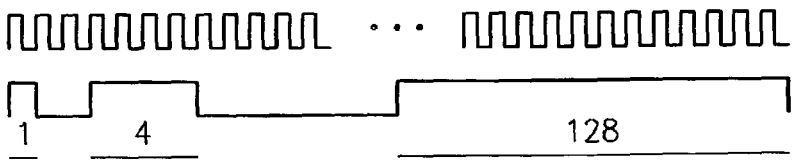
FIG. 3 is a waveform diagram of a pixel signal having modulated pulse width, which is applied to the present invention.

In the operation of the D/A converter 210, digital pixel data which is pulse width modulated (PWM), e.g., 133 (10000101B), shown in FIG. 3, is applied to the gate terminal of the switch S1. Thus, the switch S1 is turned on only in a 'high' state period of the digital pixel data having a modulated pulse width, and the capacitor C0 is charged by the current source $I_O$. As a result, the digital pixel data is converted into a pixel signal of analog voltage.

Figures 4A, 4B, 4C, 4D, 4E, 4F, 4G, 4H:
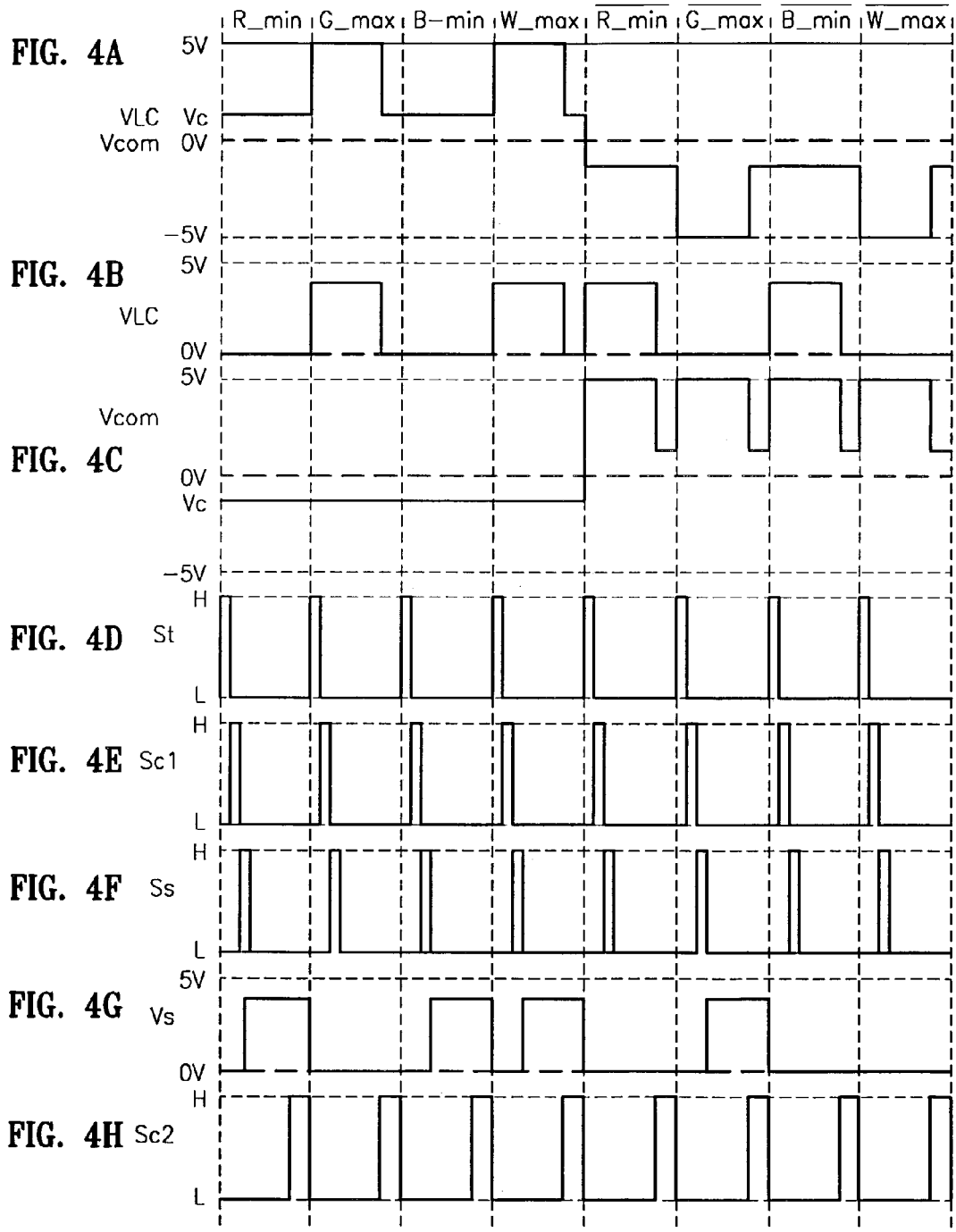
FIGS. 4A through H are waveform diagrams of major signals propagating through the circuit of FIG. 2.

The switch S2 converts digital pixel data per line into an analog signal and discharges a signal charged in the capacitor C0 and a capacitor C1 in response to a gate signal Sc1 having timing shown in FIG. 4E, in preparation for scanning a next line.

Conventionally, digital-to-analog (D/A) conversion is carried out in units of 8 pixels or 16 pixels, and thus, generation of undesired bar-type noise at a distance of 8 pixels or 16 pixels is unavoidable when displaying images. In contrast, D/A conversion according to the present invention is made in units of single pixels, thereby minimizing deterioration of quality caused during a manufacturing process of a semiconductor. Therefore, it is possible to prevent generation of undesired noise per line at a screen.

The pixel driving unit 220 is a block for generating voltage to drive a liquid crystal cell. The pixel driving unit 220 includes a plurality of switches S5 through S7, and first and second capacitors C1 and C2 which are two charging devices.

I/O terminals of the switch S5 are connected to the output terminal of the D/A converter 210 and the first charging capacitor C1, respectively. Input and output terminals of the switch S6 are connected to the capacitor C1 and the second charging capacitor C2, respectively. The output terminal of the switch S6 is also connected to the switch S7 for discharging a signal charged in the capacitor C2.

In the operation of the pixel diving unit 220, when a gate signal Ss having timing shown in FIG. 4F is applied to the gate terminal of the switch S5, the first capacitor C1 is primarily charged with an analog pixel signal that is input while each line is scanned.

The switch S6 is switched on in response to the pixel signal charged in the capacitor C1 and charges the capacitor C2 with the pixel signal, so as to display one-frame images at once in response to a gate signal St having timing shown in FIG. 4D.

The switch S7, which is connected in parallel to the capacitor C2, discharges voltage applied to the capacitor C2 and the liquid crystal cell 230, in response to a gate signal Sc2 having timing shown in FIG. 4H, after displaying one frame image and before receiving a next frame image.

Here, the capacities of the capacitors C1 and C2, and a capacitor $C_{LC}$ of a liquid crystal cell, are designed to be $C1 >> C2 >> C_{LC}$ to compensate for DC charge sharing.

Figure 5:
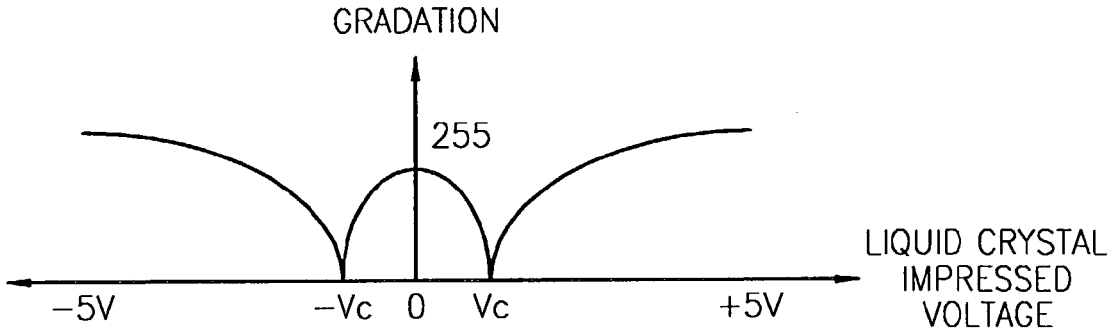
FIG. 5 is a graph illustrating the relationship between a liquid crystal impressed voltage and gradation.

Positive/negative (+/−) voltages are alternately applied per frame of the liquid crystal cell 230 to prevent the occurrence of a liquid crystal sticking phenomenon shown in FIG. 5. In detail, for alternate application of +/− voltages per frame, a pixel electrode voltage Vcom illustrated in FIG. 4C is applied to one terminal of the liquid crystal cell 230 and a voltage charged in the capacitor C2 is applied to the other terminal, across a pixel electrode, of the liquid crystal cell 230. As a result, an image can be displayed due to a voltage difference between the pixel electrode voltage Vcom and the voltage charged in the capacitor C2.

According to the present invention, the switches S1 through S7 may be formed of thin film transistors (TFTs). Hereinafter, the operations of switches S1 through S7 in +/− frames will be described.

In the '+' frame, after D/A conversion is performed on pixel data per pixel, the converted pixel data is stored in the capacitor C1 while the switch S5 is turned on per line in response to the gate signal Ss. After charging the analog pixel signal in all lines, the switch S7 is turned on in response to the gate signal Sc2 to discharge liquid crystal voltage $V_{LC}$ of each cell which displays an image in a previous frame. Next, image data of the entire sequence of frames is charged in the capacitor C2 while the switch S6 is turned on in response to the gate signal St in order to control driving of a liquid crystal device according to a switching sequence of applying a liquid crystal voltage to a current frame.

In the '−' frame, D/A conversion is performed on inverted image data in units of pixels and the pixel electrode voltage Vcom is inverted to display a pixel corresponding to the converted image data. The switching sequence of applying the liquid crystal voltage is the same as in the '+' frame.

According to the present invention, image data is converted into an analog signal in units of single pixels, pixel signals are sequentially charged per line and frame using a buffer with a dual structure, and a liquid crystal cell is driven with voltage of the pixel signal charged per frame. R.G.B. signals can be displayed on a single panel by providing image data applied to an image display device adopting an analog driving method, according to the present invention, in one vertical synchronization period that is time-divided into R/G/B/W frames, as shown in FIG. 4A.

According to the present invention, image data is processed according to a digital process and an image display device is driven in units of a pixel in response to a signal obtained by performing D/A conversion on the image data. Therefore, it is possible to prevent generation of bar-type noise in a digital image display device such as a plasma display panel (PDP), a digital micro-mirror device (DMD), or a ferro-electric liquid crystal device (FLCD). Also, it is possible to increase the number of frames per color and display images on a single panel as long as the response speed of a liquid crystal cell is maintained fast enough.

In conclusion, according to the present invention, digital image data per pixel is converted into an analog signal to generate a voltage for driving an image display device and an analog voltage for driving the image display device is generated using a driving circuit with a dual buffer structure. Therefore, it is possible to more effectively prevent generation of undesired noise than in the prior art. In particular, an image display device according to the present invention is advantageous for displaying R.G.B. signals using a single panel.

The present invention may be embodied as a method, an apparatus or a system. In a case where the present invention is accomplished by software, code segments for performing indispensable operations are required as constitutional elements. A program or code segments may be stored in a processor-readable medium or may be transmitted via a transmitting apparatus or network in response to a computer data signal that is combined with a carrier wave. Here, the processor-readable medium may be any medium capable of storing or transmitting data, e.g., an electronic circuit, a semiconductor memory device, a ROM, a flash memory, an EE PROM, a floppy disk, an optical disc, a hard disc, an optical fiber medium, or a radio-frequency (RF) net. Also, the computer data signal may be any signal that can be transmitted over a transmission medium such as electronic net channel, an optical fiber, air, an electric field, or an RF net.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An apparatus for driving an image display device, the apparatus comprising:

a digital-to analog (D/A) converter converting digital pixel data into an analog pixel signal in units of single pixels, wherein the digital pixel data is pulse width modulated;

a pixel driving unit connected to the D/A converter and receiving the analog pixel signal output from the D/A converter, switching the analog pixel signal to charge a first charging device with the analog pixel signal, switching a signal charged in the first charging device per frame to charge a second charging device with the signal charged in the first charging device, and discharging a signal for a previous frame, which is charged in the second charging device, before charging the second charging device with a signal for a current frame; and a liquid crystal cell connected to said pixel driving unit and displaying an image using a difference between voltage of the pixel signal in the second charging device and a predetermined AC driving voltage, wherein the D/A converter comprises a first switching unit switching and outputting a current from a current source in response to the digital pixel data having a modulated pulse width, a first capacitor charging a signal output from the first switching unit, and a second switching unit being connected in parallel to the first capacitor and discharging from the first capacitor the pixel signal charged with the pixel signal of a previous line before charging the first capacitor with the pixel signal for a current line.

2. The apparatus of claim 1, wherein the D/A converter further comprises a buffer circuit unit for impedance matching at an output terminal of the first switching unit.

3. The apparatus of claim 1, wherein the pixel driving unit comprises:

a third switching unit switching and outputting the analog pixel signal output from the D/A converter, in response to a gate signal generated per line;

a second capacitor charging the analog pixel signal output from the third switching unit;

a fourth switching unit switching and outputting the analog pixel signal charged in the second capacitor in response to a first gate signal generated per frame;

a third capacitor charging the analog pixel signal output from the fourth switching unit; and a fifth switching unit being connected in parallel to the third capacitor and discharging the pixel signal charged in the previous frame in response to a second gate signal generated per frame before charging the third capacitor with the pixel signal in the current frame.

4. The apparatus of claim 3, wherein a capacity of the second capacitor is larger than a capacity of the third capacitor, and a capacity of the third capacitor is larger than a capacity of the liquid crystal cell.

5. The apparatus of claim 1, wherein the predetermined AC driving voltage is set to be switched between positive voltage and negative voltage in units of frames.

6. A method for driving a liquid crystal cell for use in a image display device, the method comprising:

converting digital pixel data which has a modulated pulse width into an analog pixel signal in units of single pixels, wherein a first switching unit switches and outputs a current in response to the digital pixel data, a first capacitor charges a signal output from the first switching unit, and a second switching unit, which is connected in parallel to the first capacitor and discharges from the first capacitor the pixel signal of a previous line before charging the first capacitor with the pixel signal for a current line;

switching the analog pixel signal per line to charge a first charging unit with the signal;

switching a signal charged in the first charging unit to charge a second charging unit with the signal charged in the first charging unit;

driving the liquid crystal cell in response to a signal charged in the second charging unit; and discharging a signal for a previous frame, which is charged in the second charging unit, before charging the second charging unit with a signal for a current frame.

7. The method of claim 6, wherein the capacity of the first charging unit is larger than that of the second charging unit, and the capacity of the second charging unit is larger than that of the liquid crystal cell.

8. An apparatus for driving an image display device, the apparatus comprising:

a digital-to-analog (D/A) converter converting digital pixel data into an analog pixel signal in units of single pixels;

a pixel driving unit connected to the D/A converter and receiving the analog pixel signal output from the D/A converter, switching the analog pixel signal to charge a first charging device with the analog pixel signal, switching a signal charged in the first charging device per frame to charge a second charging device with the signal charged in the first charging device, and discharging a signal for a previous frame, which is charged in the second charging device, before charging the second charging device with a signal for a current frame; and a liquid crystal cell connected to said pixel driving unit and displaying an image using a difference between voltage of the pixel signal in the second charging device and a predetermined AC driving voltage, wherein the capacity of the first charging device is larger than that of the second charging device, and the capacity of the second charging device is larger than that of the liquid crystal cell.

9. A method for driving a liquid crystal cell for use in an image display device, the method comprising:

converting digital pixel data into an analog pixel signal in units of single pixels;

switching the analog pixel signal per line to charge a first charging unit with the signal;

switching a signal charged in the first charging unit to charge a second charging unit with the signal charged in the first charging unit;

driving the liquid crystal cell in response to a signal charged in the second charging unit; and discharging a signal for a previous frame, which is charged in the second charging unit, before charging the second charging unit with a signal for a current frame, wherein the capacity of the first charging unit is larger than that of the second charging unit, and the capacity of the second charging unit is larger than that of the liquid crystal cell.

* * * * *